US007446482B2

(12) United States Patent
Sugaya

(10) Patent No.: US 7,446,482 B2
(45) Date of Patent: Nov. 4, 2008

(54) HIGH PRESSURE DISCHARGE LAMP LIGHTING APPARATUS

(75) Inventor: Katsumi Sugaya, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 38 days.

(21) Appl. No.: 11/730,204

(22) Filed: Mar. 30, 2007

(65) Prior Publication Data

US 2007/0228996 A1 Oct. 4, 2007

(30) Foreign Application Priority Data

Mar. 31, 2006 (JP) ..... 2006-096924

(51) Int. Cl.
*H05B 37/00* (2006.01)
*H05B 37/02* (2006.01)

(52) U.S. Cl. ..... 315/200 R; 315/209 R

(58) Field of Classification Search ..... 315/209 R, 315/291, 307, DIG. 2, DIG. 4–5, 209 T, 200 R, 315/209 CD, 362, DIG. 7; 313/537, 632, 313/633, 639, 311, 491, 493
See application file for complete search history.

(56) References Cited

U.S. PATENT DOCUMENTS 6,850,015 B2 * 2/2005 Ishizuka et al. ..... 315/224
6,927,539 B2 8/2005 Arimoto et al.
7,015,655 B2 * 3/2006 Kamoi et al. ..... 315/291
7,077,530 B2 * 7/2006 Chen et al. ..... 353/122
7,116,053 B2 * 10/2006 Claus et al. ..... 315/108
7,239,089 B2 * 7/2007 Suzuki et al. ..... 315/209 R
2005/0151471 A1 * 7/2005 Morimoto ..... 313/575

FOREIGN PATENT DOCUMENTS

JP 2004-172086 A 6/2004

* cited by examiner

*Primary Examiner*—Douglas W. Owens
*Assistant Examiner*—Minh Dieu A
(74) *Attorney, Agent, or Firm*—Rader, Fishman & Grauer, PLLC

(57) ABSTRACT

A high pressure discharge lamp lighting apparatus comprises a high pressure discharge lamp including a discharge container made of quartz glass in which mercury and halogen is enclosed, and a first and second electrodes in which the first electrode is larger than the second electrode in size and face each other, a power supply section which turns on the discharge lamp by impressing a voltage of opposite polarity by turns between the pair of electrodes of the high pressure discharge lamp. In the lamp lighting apparatus, a control is carried out by the power supply section, so that a first period during which a positive voltage is impressed to the first electrode is longer than a second period during a positive voltage is impressed to the second electrode.

7 Claims, 13 Drawing Sheets

$1\% \leqq T2/T1 \leqq 45\%$

FIG. 3A
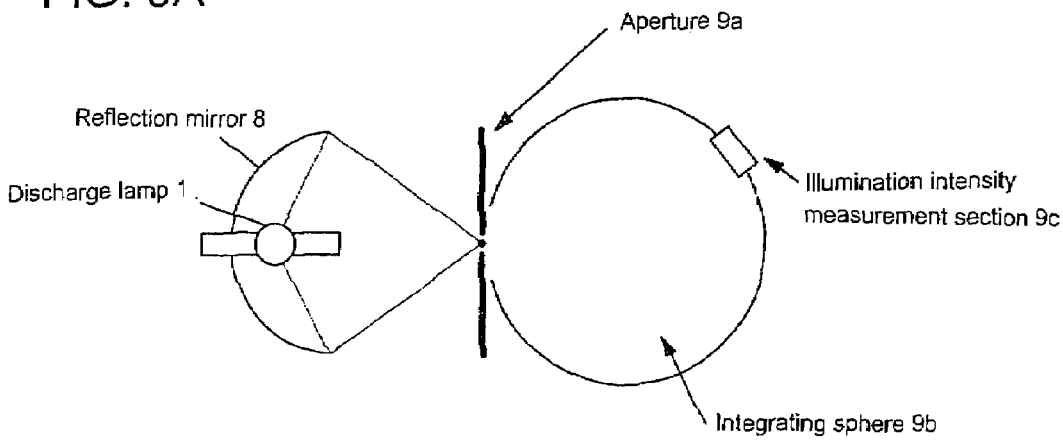
FIG. 3B
| Duty ratio of current | Illuminance ratio | |
|---|---|---|
| | Aperture diameter | |
| | Φ3 | Φ6 |
| 1% | 105% | 100% |
| 10% | 105% | 100% |
| 30% | 103% | 100% |
| 45% | 101% | 100% |
| 50% | 100% | 100% |
FIG. 3C
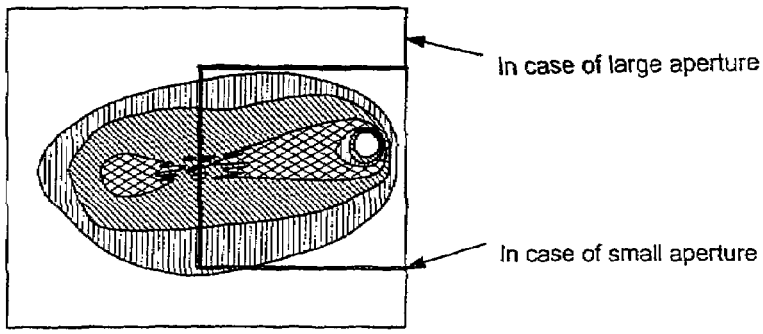

FIG. 5

| Lamp voltage | Duty ratio |
|---|---|
| $100 \leqq VL$ | 5% |
| $90 \leqq VL < 100$ | 10% |
| $80 \leqq VL < 90$ | 20% |
| $70 \leqq VL < 80$ | 30% |
| $VL < 70$ | 45% |

HIGH PRESSURE DISCHARGE LAMP LIGHTING APPARATUS

CROSS-REFERENCES TO RELATED APPLICATION

This application claims priority from Japanese Patent Application Serial No. 2006-96924 filed on Mar. 31, 2006, the contents of which are incorporated herein by reference in its entirety.

TECHNICAL FIELD

Described herein is a high pressure discharge lamp lighting apparatus, and specifically to a high-pressure discharge lamp lighting apparatus which can be suitably used as a light source of a projector apparatus.

BACKGROUND

A projection type projector apparatus is required to uniformly project an image with sufficient color rendering properties on a rectangle screen, and a high pressure discharge lamp of high mercury vapor pressure is used as a light source of such a projector apparatus. This is because light having a visible wavelength band can be obtained on a high output by increasing the pressure of mercury vapor.

The extra high pressure mercury lamps which have such a feature are roughly classified into an AC discharge lamp and a DC discharge lamp in terms of the lighting system.

Each of such lamps has its own features, and in the AC discharge lamp, projections are formed at the tips of electrodes, and consumption and growth of almost equal luminescent spots are repeated at a front face of each projection, so that a high lumen maintenance factor can be obtained for a long time. The high-pressure discharge lamp lighting apparatus using such an AC discharge lamp is disclosed, for example, in patent documents 1. In patent document 1, in order to stably maintain the distance between electrodes, when the lighting voltage of the discharge lamp drops less than a lower limit, the lighting frequency of the discharge lamp is decreased so that the lighting voltage is increased.

On the other hand, since in a DC discharge lamp, only one luminescent spot is generated in front of a cathode thereof, it is possible to use light efficiently in a small optical device. Although this technology is advantageous in the miniaturization of recent projectors, since the anode side is worn out constantly, it is difficult to keep the arc length constant, and a lumen maintenance factor is not good. By the way, types of projector apparatuses are in general divided into a system using DLP (registered trademark) and a system using a liquid crystal panel.

In the system using the DLP (registered trademark), as shown in FIG. 10, radiation light emitted from a light source 110 is irradiated in a time dividing manner on a special modulation element 115 (which is also called a light modulation device, and is, for example, a DMD element (Digital Micro-mirror Device)) through a lens 111, a color wheel (rotation filer) 112 in which divided RGB areas are formed, a rod integrator 113, and a lens 114, and specific light is reflected by the DMD element so as to be irradiated onto a screen 117 through a lens 116 for projection. The DMD element is formed by arranging a couple of million of tiny mirrors, each of which corresponds to a pixel, and the direction of each tiny mirror is controlled so as to control light projection. Since it is not necessary to use three liquid crystal panels while the DLP (registered trademark) system has a simple optical system, as compared with a liquid crystal system, it is advantageous that the structure of the entire apparatus can be miniaturized and simplified.

On the other hand, in the liquid crystal panel, there are an one-sheet type liquid crystal panel and a three-sheet type liquid crystal panel. In either type, light emitted from a light source is separated into three colors (RGB), and light transmission adjustment is carried out on light which is related to image information in a liquid crystal panel. After that, the three colors which transmitted through the panel, are synthesized so as to project the synthesized image on a screen.

FIG. 11 is a schematic view of the structure of a projector apparatus which has a liquid crystal panel.

As shown in the figure, light emitted from a lamp 100 is made into a uniform light by an integrator lens (fly eye lens) 101, and made into the light with only S polarization by a polarization conversion element 102. This light with S polarization enters to dichroic mirrors 104-106 through a mirror 103, and the white light is separated into RGB. The separated lights are reflected by mirrors 107, after passing an LCD panels 108, it is synthesized by a dichroic prism 109, so that an image is generated.

SUMMARY

In connection with the needs of the miniaturization of a projector apparatus, and extension of the life span of a lamp, the demand for an extra high pressure mercury lamp lighting apparatus with a small luminescent spot and the arc length with a small change during the life span has grown.

The reason of such demand is set forth below. An example of a DMD element as an image element will be explained below, referring to FIG. 12.

As shown in FIG. 12, light emitted from the lamp 110 is, in a time dividing manner, separated into RGB which are the three primary colors of light by passing them through a color wheel (rotation filter) 112. After that, the light becomes a uniform light by repeating reflection within the rod integrator 113. The uniform light is irradiated onto the DMD element 115 which is a reflection type image element, so that an image is generated. In order to miniaturize such a projector, it is necessary to shorten an arc length in a light source in addition to miniaturization of an optical system and the DMD element which is an image element.

FIG. 13 shows the result of simulation calculation of the condensing rate, based on etendue of a projector when changing the arc length (AL) by 0.2 mm at a time, from 1.4 mm to 0.8 mm. Here, "an etendue" means, [an area of a light source which can be used]×[solid angle] (for example, in FIG. 12, Ω×S1, wherein S1 is the area of a rod integrator). Although the light collecting rate falls with a decline of an etendue, it turns out that as shown in FIG. 13, the shorter the arc length of a lamp is, the smaller decline in the condensing rate is.

In order to make a projector small, it is necessary to make the optical system small. For example, although the size of the reflection mirror of the light source, the size of a rod integrator, etc. can be made small in the example of FIG. 12, if the arc length of the lamp is made long, an arc image runs over the edge of the rod integrator so that the use efficiency of light declines. That is, if the arc length of the lamp is shortened, in a small projector (whose etendue is small), the decline in a light collecting rate can be prevented. The same is true in case that an LCD shown in the FIG. 11 is used as an image element. That is, the arc length needs to be shorten, in order to miniaturize a projector, in addition to the miniaturization of the optical system, as in the case where a DMD element. The high-pressure discharge lamp lighting apparatus has a small luminescent spot, good optical use efficiency, and a little change of the arc length during a life span of the lamp, in which the life span can be extended, even if it applies to a small projector apparatus.

In order to solve the problem, the duty of the current supplied to a lamp is unbalanced (biased). In this manner, it is possible to offer a high pressure mercury lamp lighting apparatus with high brightness and a little arc length change during the life span.

A pair of electrodes whose sizes differ from each other is arranged, the electrodes facing each other in an electric discharge container made of quartz glass. The high pressure discharge lamp lighting apparatus comprises a high pressure discharge lamp, in which mercury and halogen are enclosed in an electric discharge container and a power supply apparatus in which the opposite polarity of a voltage is impressed by turns to a pair of electrodes of the high pressure discharge lamp so as to turn on the discharge lamp. A period [T1-T2] (T1 is a cycle) for impressing a voltage to the positive side of the larger electrode is made longer than a period T2 for impressing a voltage to a positive side of the smaller electrode.

(2) In addition, the ratio of the period [T1-T2] and the period T2 is changed according to the lamp voltage.

The following effects can be acquired in the present embodiment.

(1) The period [T1-T2] (T1 is a cycle) for impressing a voltage to a positive side of the larger electrode is made longer than the period T2 for impressing a voltage to positive side of a smaller electrode so that the luminance distribution can be biased toward one of the electrodes. For this reason, the extra high pressure mercury lamp lighting apparatus has a small luminescent spot, a little change of the arc length in a life span, and the good use efficiency of light.

(2) Moreover, the ratio of the period [T1-T2] and the period T2 may be changed, according to a lamp voltage, that is, according to the lamp voltage, i.e., the distance between electrodes, luminescent-spot distribution can be biased toward one of the electrodes is changed so as to increase the use efficiency of light.

BRIEF DESCRIPTION OF DRAWINGS

Other features and advantages of the present high pressure discharge lamp lighting apparatus will be apparent from the ensuing description, taken in conjunction with the accompanying drawings, in which:

FIG. 3A shows a measurement apparatus for measuring lamp illuminance while the duty ratio is changed;

FIG. 3B shows the relation between the duty ratio and the illuminance ratio which is a measurement result;

FIG. 3C shows luminance distribution;

FIG. 5 shows the relation of the set value of a lamp voltage and a duty ratio;

DETAILED DESCRIPTION

Figure 1A:
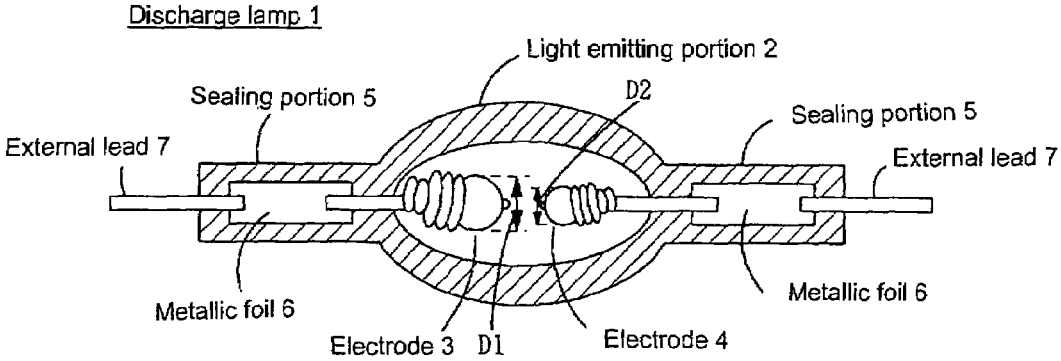
FIG. 1 shows the structure and an example of the current waveform of a discharge lamp which is used in an embodiment.

FIG. 1A shows the structure of a discharge lamp according to an embodiment.

As shown in this figure, the discharge lamp 1 has a light emission portion 2 made from a quartz glass electric discharge container, in which a pair of electrodes 3 and 4 whose sizes are different from each other are arranged facing each other. Moreover, sealing portions 5 are formed so as to extend from both ends of the light emission portion 2, and in each of these sealing portions 5, a metallic foil 6 for electric conduction which is made of molybdenum, is usually airtightly buried. An axial section of each of the electrodes 3 and 4 is welded to the metallic foil 6, so as to be connected electrically thereto, and the external lead 7 which projects outside is welded to the other end of each metallic foil 6. In the electric discharge container, mercury of 0.2 $mg/mm^3$ or more, and halogen of $10^{-6}$ to $10^{-2}$ $\mu mol/mm^3$ is enclosed. Each of the electrodes 3 and 4 is approximately spherical and is a fused electrode which is formed by winding a fused coil at the tip of an internal lead which supports the electrode. As to the sizes of the electrodes 3 and 4, in case of turning on the lamp at 200 W, for example, the fused diameter D1 of the larger electrode is $1.5 \leqq D1 \leqq 1.7$ mm, and the fused diameter D2 of the smaller one is $1.5 \leqq D2 \leqq 1.3$ mm.

Figure 1B:
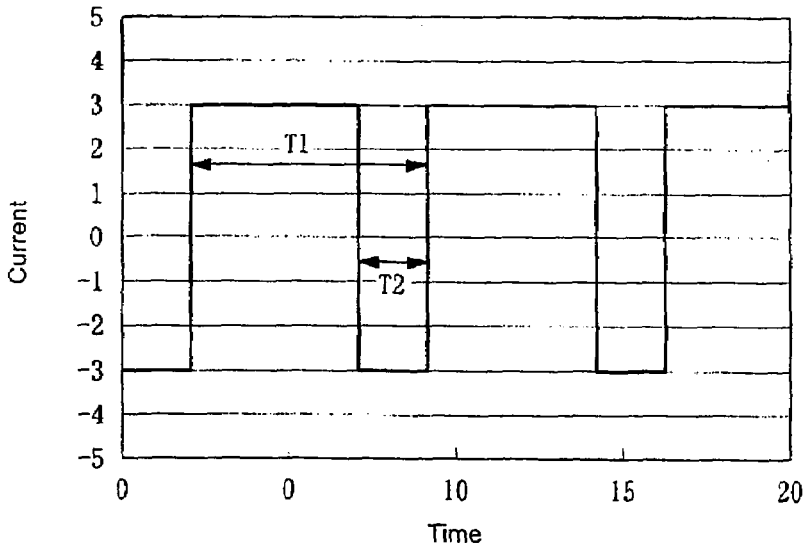

In this embodiment, a voltage with unbalanced duty (between a period in a cycle of positive voltage applied the electrode 3 and that in a cycle of positive voltage applied to the electrode 4) is impressed to the electrodes 3 and 4. That is, a period of positive voltage applied to the electrode 3 is set so as to be longer than a period of positive voltage applied to the electrode 4 so that, as shown in FIG. 1B, a period (T1-T2) when current flows from the electrode 3 to the electrode 4 is longer than a period (T2) when current flows from the electrode 4 to the electrode 3. In addition, although the T1 represents one cycle and is usually fixed, the period (T1-T2) or T2 may be fixed so that a period for one cycle may be changed. Here, T2/T1 is called a duty. Although the discharge lamp shown in FIG. 1A has the electrode (anode) 3 which is larger than the electrode (cathode) 4 and is structurally close to a DC discharge lamp, in the present embodiment, an alternating current with an unbalanced (biased) duty flows through the lamp. Therefore, such a lamp is called a duty control type AC discharge lamp. Moreover, although during lighting of the lamp, the alternating current with the unbalanced duty flows between the electrode 3 and 4, since the relation of (T1-T2) and T2 is (T1-T2)>T2, the electrode 3 is called an anode and the electrode 4 is called a cathode.

Figure 2A:
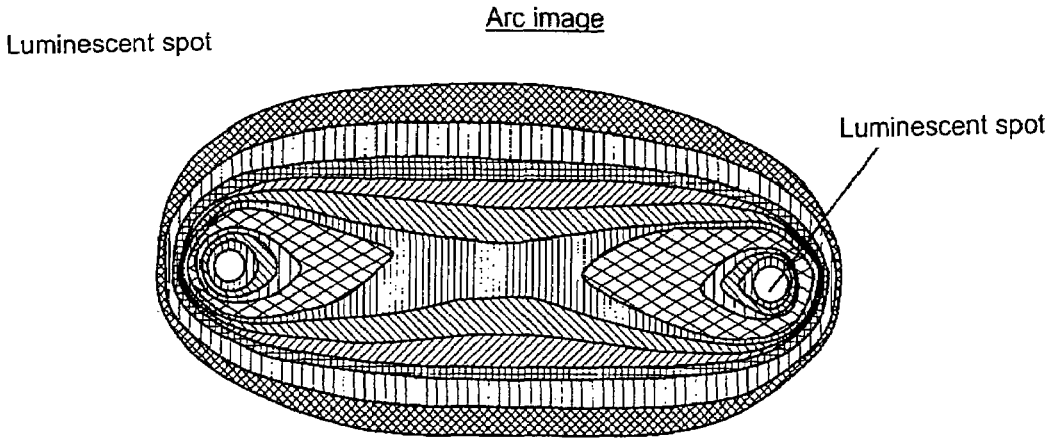
FIG. 2 shows the luminance distributions of an AC discharge lamp and a DC discharge lamp.
Figure 2B:
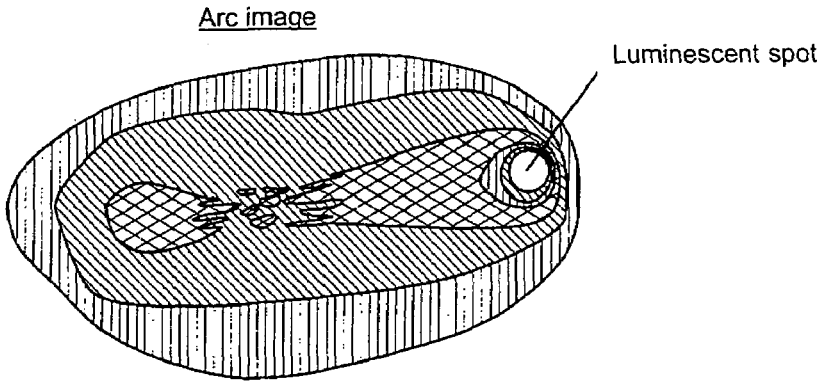

FIG. 2A shows the luminance distribution of the conventional AC discharge lamp and FIG. 2B shows the luminance distribution of the conventional DC discharge lamp. In the AC discharge lamp, an alternating current flows between electrodes, so as to turn on the lamp, and as shown in FIG. 2A, while an arc is generated between the electrodes, the luminescent spots are generated near the electrodes, respectively. That is, two luminescent spots are generated. In such the AC discharge lamp, as mentioned above, when a projection is generated at the tip of each electrode and consumption and growth of an almost equal luminescent spot in a front face of each projection is repeated, so that a high lumen maintenance factor is obtained for a long time, but the two luminescent spots are generated as mentioned above. If these two luminescent spots are used as a light source of a small projector, the arc length of the lamp becomes long so that a light collecting rate falls.

On the other hand, in case of the DC discharge lamp, a direct current flows between electrodes so as to turn on the lamp, and a luminescent spot is generated only near the cathode (the electrode in a side in which the current flows in) while an arc occurs between the electrodes, as shown in FIG. 2B. That is, since the number of the luminescent spots is one, the arc length of the lamp is short so that it is possible to use light efficiently in a small projector. However, since the anode side is worn out constantly as mentioned above, it is difficult to keep the arc length constant, and a lumen maintenance factor is not good.

In a duty control type AC discharge lamp according to the embodiment, that is, in the discharge lamp as shown in FIG. 1A, an alternating current with unbalanced duty flows as shown in FIG. 1B, so that the luminance distribution thereof is deviated toward a front face of one of the electrodes. For this reason, an arc image is biased toward the front of the electrode (cathode) like a DC discharge lamp shown in FIG. 2B, and the arc image does not become long like an AC discharge lamp shown in FIG. 2A. Therefore, it is possible to use light efficiently in a small projector. Furthermore, since an alternating voltage is impressed to the lamp, the anode side is not going to be worn out constantly like the DC discharge lamp, and compared with the DC discharge lamp, there is also little change of the arc length during a life span thereof.

The duty ratio (T2/T1) of the current which flows through the duty control type AC discharge lamp according to this embodiment is changed, and the illuminance (illumination intensity) of a lamp was examined. The measurement of the illumination intensity was conducted by using an optical system as shown in FIG. 3A.

In FIG. 3A, a duty control type AC discharge lamp 1 is lighted by impressing an alternating voltage whose duty is unbalanced (biased) as mentioned above. Light emitted from the discharge lamp 1 is condensed by a reflection mirror 8, and the condensed light enters into an integrating sphere 9*b* through an aperture 9*a*. An illumination intensity measurement section 9*c* is provided in the integrating sphere 9*b*, and the illumination intensity of the light which enters through aperture 9*a* was measured. Here, the apertures of ϕ3 mm and ϕ6 mm in diameter were used. In each of measurements in which ϕ3 mm and ϕ6 mm apertures are used, a measured value in case of 50% duty ratio was regarded as a 100% illuminance value, and change of illuminance is shown in FIG. 3B when changing a duty ratio from 50%.

As shown in FIG. 3B, although, in the case of ϕ6 mm, even if the duty ratio is changed, no brightness change was seen, and in the case of ϕ3 mm aperture, if the duty ratio was decreased, the tendency was that the brightness was increased.

This phenomenon can be explained from the luminance distribution of FIG. 3C. That is, when the aperture was ϕ6 mm (large), the area capable of using light is large, and it is possible to take in the light of the whole arc surrounded by the outer frame of FIG. 3C. In this case, even if the duty ratio of a current value is changed so as to bias the luminance distribution, no change was seen. That is, even if the duty ratio is changed, the illuminance of the whole arc surrounded by the outer frame of FIG. 3C is not changed. On the other hand, when the aperture is ϕ3 mm (small), although the light of the area surrounded by the thick line of FIG. 3C can be taken in, the light of the whole arc surrounded by the frame could not be taken in, and only the light near the luminescent spot shown in FIG. 3C could be taken in, in the illuminance measurement. In this case, the smaller the duty ratio (T2/T1) is, the larger an illuminance ratio becomes, as shown in FIG. 3B. That is, when the duty ratio was decreased more than that in the case of 50% duty ratio, so that the luminance distribution is biased toward one of the electrodes, the brightness was increased because the use efficiency of light may rise.

Next, description of an example of the structure of a lighting apparatus in order to turn on the lamp will be given.

Figure 4:
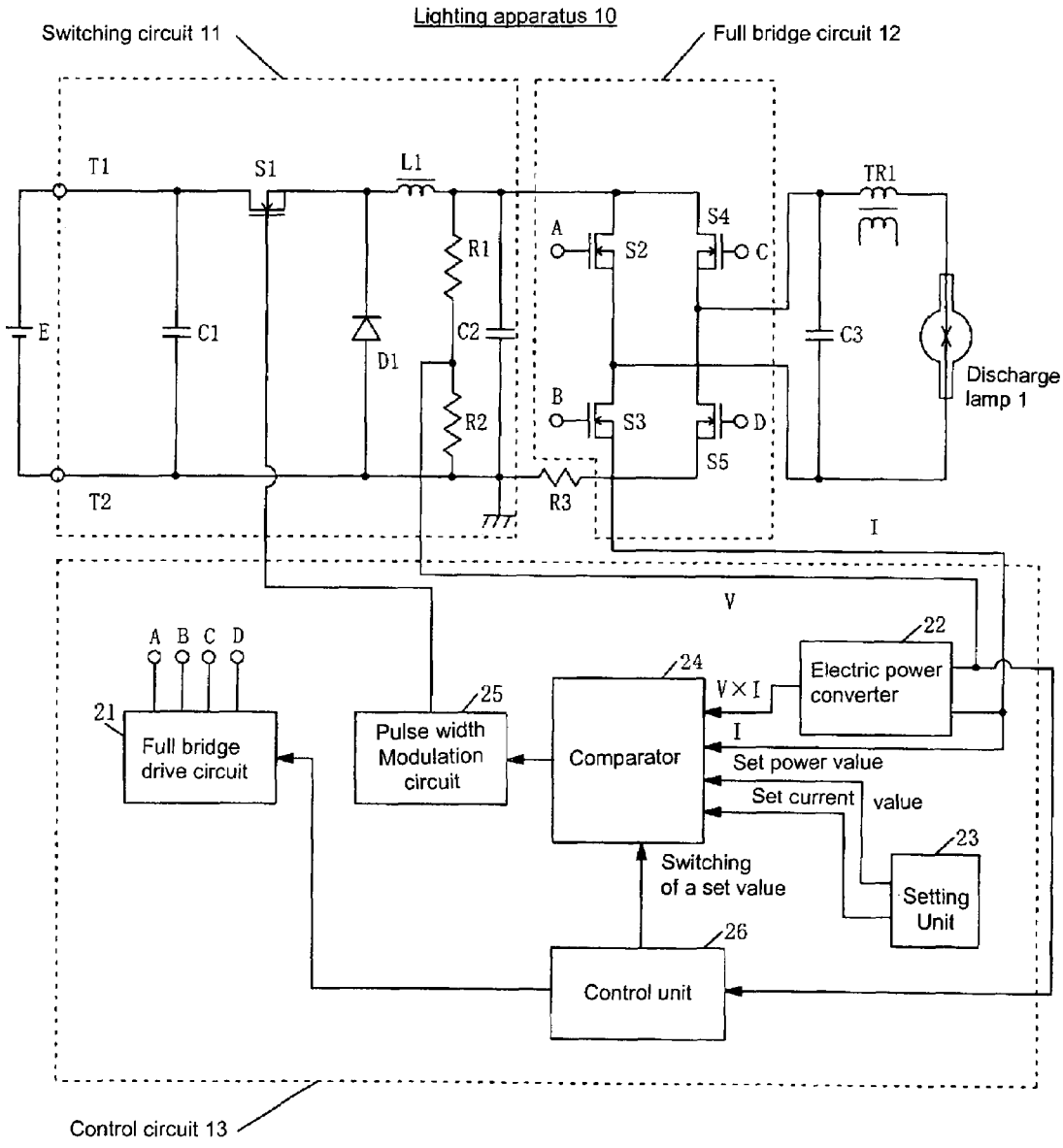
FIG. 4 shows the structure of a discharge lamp lighting apparatus according to an embodiment.

FIG. 4 shows an example of structure of the discharge lamp lighting apparatus in this embodiment. The lighting apparatus 10 shown in FIG. 4 comprises a switching circuit 11 in which electric power is controlled by pulse width control of the switching element S1, a full bridge circuit 12 which comprises switching elements S2-S5 which transform the direct-current electric power of the switching circuit 11 into alternating current rectangle waveform electric power, and a control unit 13 which controls the switching circuits 11 and the full bridge circuit 12, respectively. The transformer TR1 for an igniter is connected in series to a discharge lamp 1, and a capacitor C3 is in series connected to the discharge lamp 1 and the transformer TR1, in which an alternating current rectangle waveform is supplied to the series circuit formed by the discharge lamp 1 and the transformer TRI from the full bridge circuit 12, so that the discharge lamp 1 is turned on. The structure of the discharge lamp 1 is shown in FIG. 1A.

The switching circuit 11 comprises a capacitor C1, a switching element S1, in which a switching operation is carried out by the output of the control unit 13, a diode D1, an inductance L1, and a smoothing capacitor C2. The ON/OFF ratio of the switching element S1 is controlled by a pulse width modulation circuit 25 of the control unit 13, so that the electric power supplied to the discharge lamp 1 through the full bridge circuit 12 is controlled. Moreover, in order to detect a voltage and a current supplied to the discharge lamp 1 from the switching circuit 11, the resistors R1 and R2 for voltage detection and a resistor R3 for current detection are provided, respectively. The full bridge circuit 12 comprises the switching elements S2-S5, each of which comprises a transistor or an FET, in which the switching elements are connected in form of a bridge. The switching elements S2-S5 are driven by the full bridge drive circuit 21 provided in the control unit 13, and as mentioned above in the discharge lamp 1, the alternating current rectangle waveform current with unbalanced duty is supplied, so as to turn on the discharge lamp 1. That is, the switching elements S2 and S5 and the switching elements S3 and S4 are turned on alternately, and the alternating current rectangle waveform is supplied to the discharge lamp 1 in the path of the switching circuit 11→the switching element S2→the discharge lamp 1→the switching element S5→the switching circuit 11, and the switching circuit 11→the switching element S4→the discharge lamp 1→the switching element S3→the switching circuit 11, so that the discharge lamp 1 is turns on. In case of driving the switching elements S2-S5, in order to prevent turning on simultaneously switching elements S2-S5, a period (dead time Td) in which all the switching elements S2-S5 are turned off is provided, when the polarity of the alternating current rectangle waveform is changed.

The control circuit 13 comprises the full bridge drive circuit 21, an electric power converter 22, a setting unit 23, a comparator 24, a pulse width modulation circuit 25, and a control unit 26. The electric power converter 22 multiplies a voltage signal and a current signal which are detected by the resistors R1, R2, and R3, so as to convert them into an electric power signal. After lighting of the lamp 1, by the comparator 24, the electric power signal is compared with a reference electric power value which is set up by a setting unit 23, and the switching element S1 is controlled in a feedback manner by the pulse width modulation unit 25. Thereby, the so-called constant electric power control which makes electric power for lighting the lamp 1 constant is carried out. Moreover, the switching elements S2-S5 are driven, as mentioned above, by the full bridge drive circuit 21 through the control unit 26. In addition, as described below, the polarity of the full bridge circuit is fixed until a state of discharge shifts to arc discharge when the lamp lighting is started and a direct current voltage is impressed to the lamp 1. And after shifting to the arc discharge, although the lamp 1 is driven by the alternating current, constant current control is performed so that lamp current may become fixed, until the voltage of the lamp 1 is increased to a predetermined voltage. During this constant current control, the comparator 24 compares a lamp current with a set current value, and the switching element S1 is controlled in a feedback manner, so that lamp current may become constant by the pulse width modulation circuit 25.

In the discharge lamp lighting apparatus according to the embodiment, the duty ratio of the current of the discharge lamp 1 is in range of 1 to 45% when it is lighted. Therefore, it is possible to extend a period which is a cathode cycle more than that of the other electrode, so that the luminance distribution can be biased toward one of the electrodes. Moreover, during the life span of the lamp, the arc length is extended by consumption of an electrode, so that lamp voltage also can go up. In cases of such a phenomenon, in the embodiment, the duty ratio is decreased (45%→1%) according to the rise of voltage.

Description of this control method will be given below.

As shown in FIG. 5, the set values for determining the duty ratio to be used to turn on the lamp at each lamp voltage, are stored in the control unit 26, and in early stage of the life span, for example, when the voltage of the lamp is 75 V, the lamp is turned on with the current of a 30% duty ratio. For example, when the lamp voltage is changed so as to exceed 80V, the control unit 26 determines that the lamp voltage is changed, and outputs a signal to the full bridge drive circuit 21, so that the duty ratio is changed to 20%, and, when the full bridge drive circuit 21 receives the signal, it drives the switching elements S2-S5.

A control unit 26 comprises, for example, a microcomputer etc., and realizes the duty ratio control processing by software.

Figure 6:
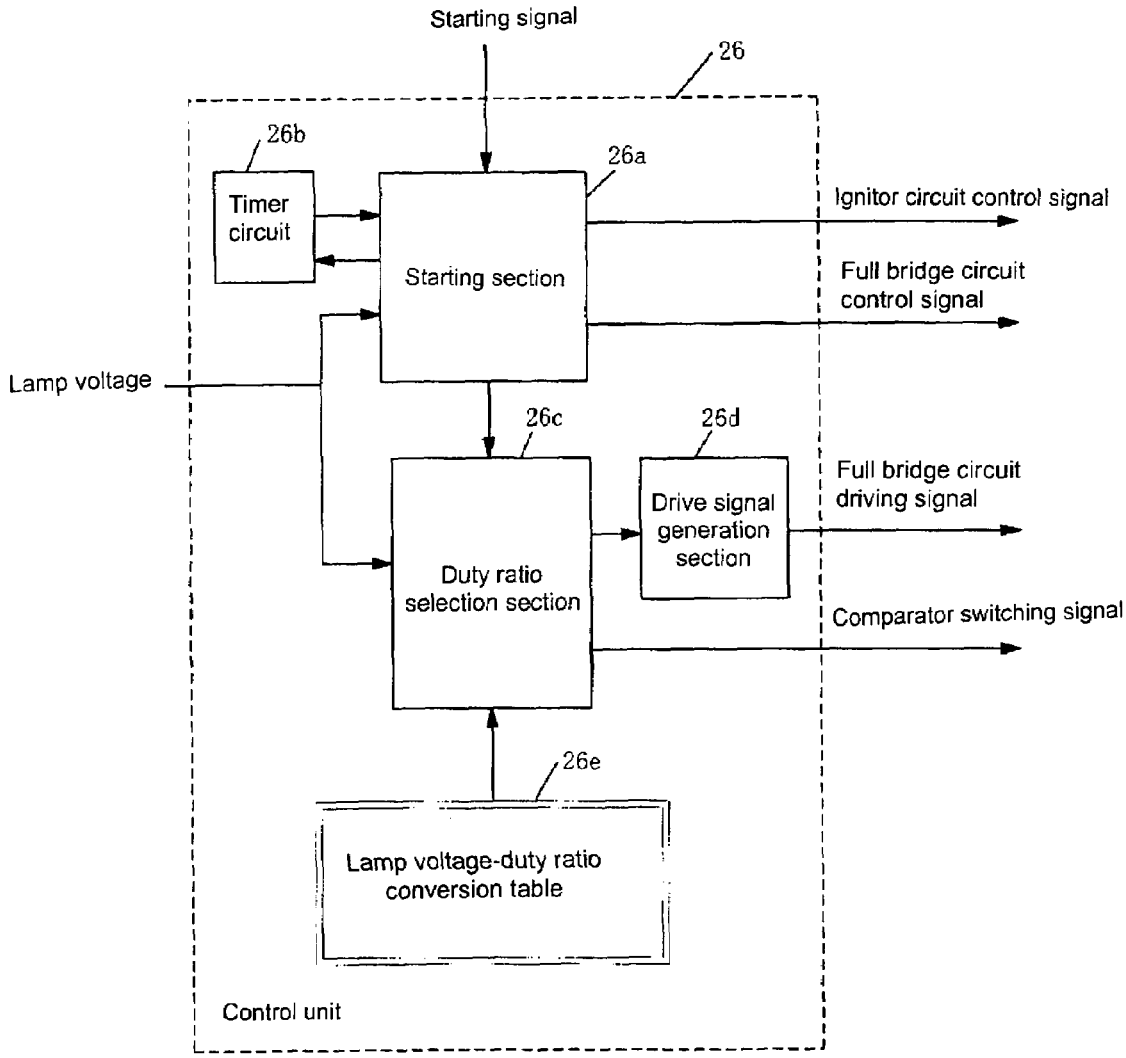
FIG. 6 is a functional block diagram of a control unit shown in FIG. 4.

FIG. 6 is a block diagram showing the functional structure of the control unit 26. The lamp voltage divided by resistors R1 and R2 is inputted into the control unit 26, and is converted into a digital signal by a built-in analog-to-digital converter (not shown). Moreover, a memory section is provided in the control unit 26, and a lamp voltage-duty ratio conversion table 26*e* shown in FIG. 6 is stored in the memory section. The set values for determining what duty ratio should be used in order to turn on the lamp at each lamp voltage shown, for example, in FIG. 5 are stored in the table 26*e*. The duty ratio selection section 26*c* reads out the duty ratio corresponding to the lamp voltage converted into the digital signal with reference to the table 26*e*, and gives it to a drive signal generation section 26*d*. The drive signal generation section 26*d* generates a drive signal of the duty ratio, and outputs it to the full bridge drive circuit 21. According to the signal, the full bridge drive circuit 21 drives the switching elements S2-S5 by the duty ratio.

Figure 7:
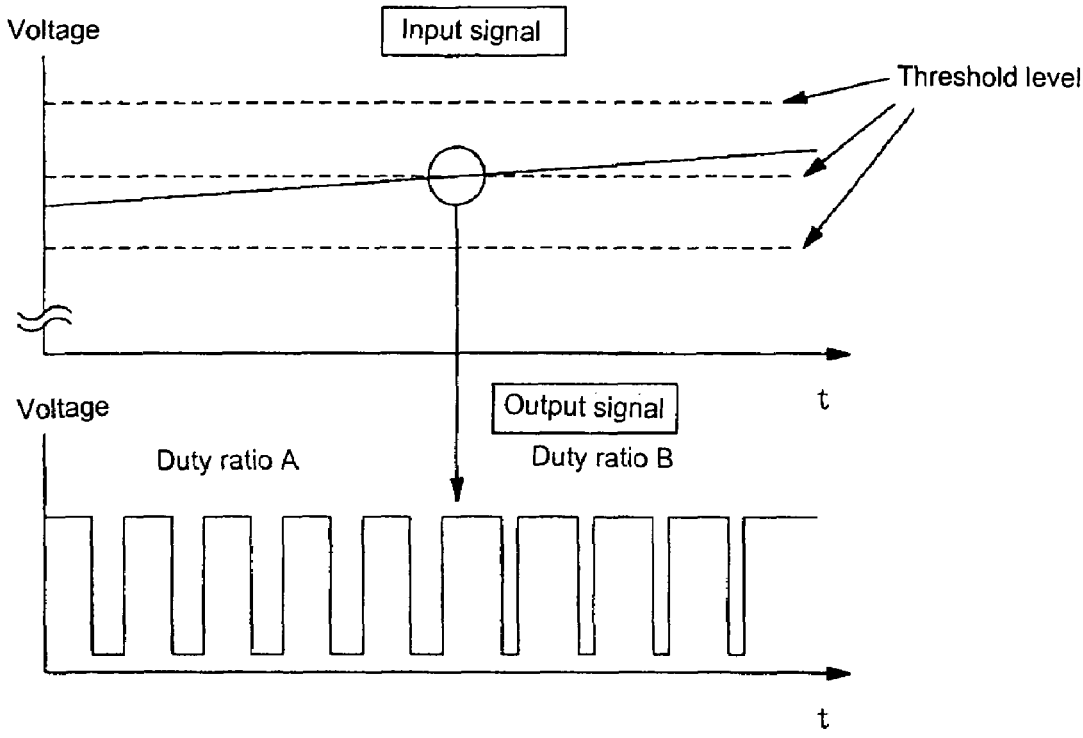
FIG. 7 is a diagram for explaining control of a duty ratio.

FIG. 7 is a diagram explaining control of the duty ratio. If the lamp voltage goes up and exceeds a predetermined threshold level as shown in this figure, the duty ratio selection section 26*c* changes the duty ratio from A to B. Moreover, the control unit 26 has a timer 26*b* and a starting section 26*a*, in which the starting section 26*a* controls the full bridge circuit 12 and an igniter circuit according to the output of the timer circuit 26*b* and the lamp voltage, so as to turn on the lamp.

Figure 8:
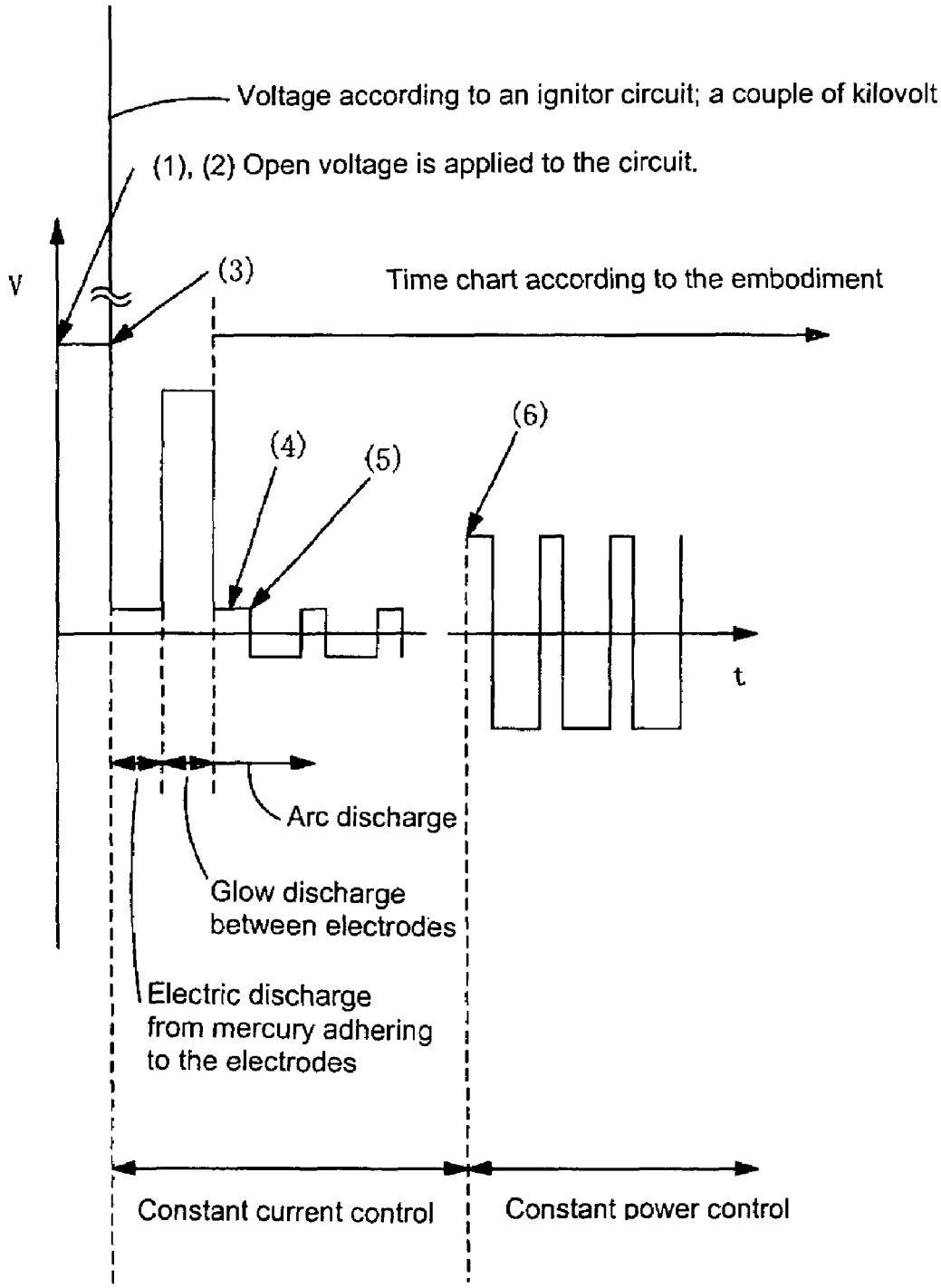
FIG. 8 is a timing chart at the time of a lamp lighting start.
Figure 9:
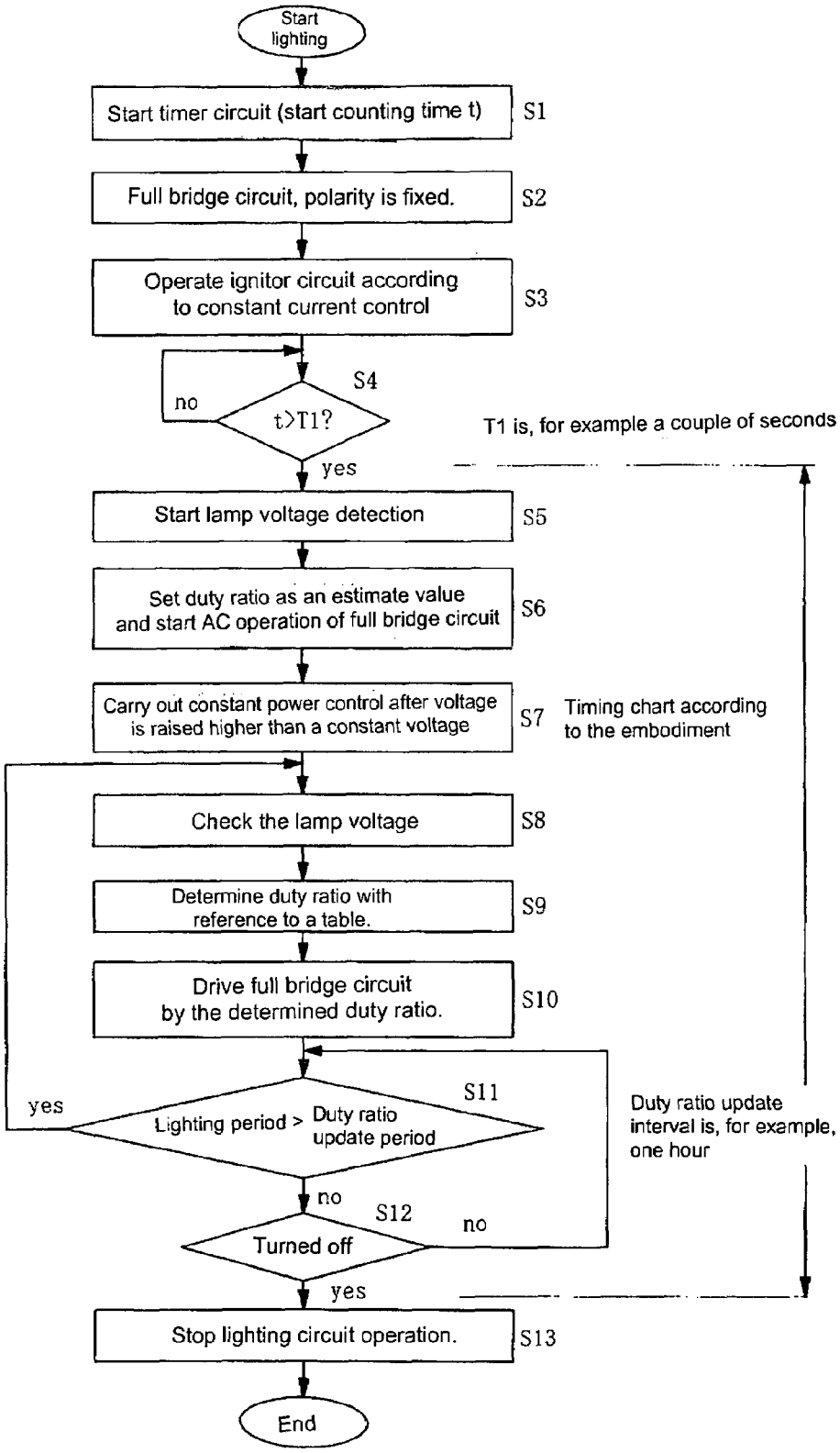
FIG. 9 is a flow chart showing an operation of a control unit.
Figure 10:
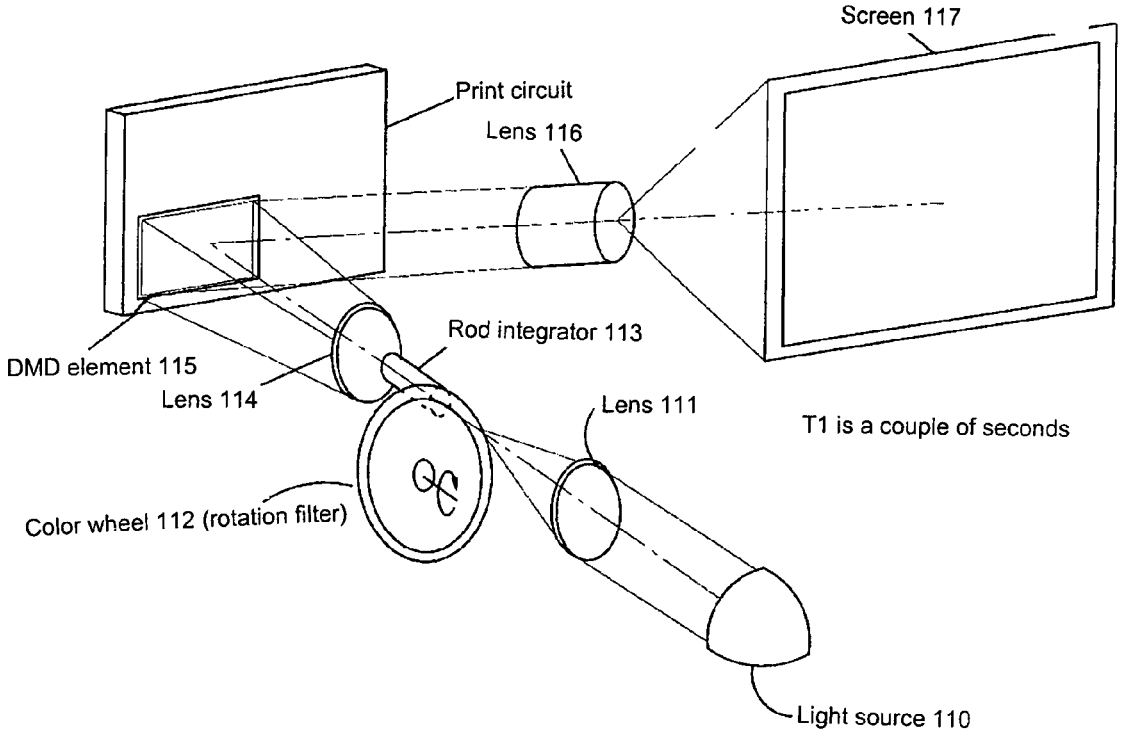
FIG. 10 shows schematic structure of a projector apparatus which uses a DMD element.
Figure 11:
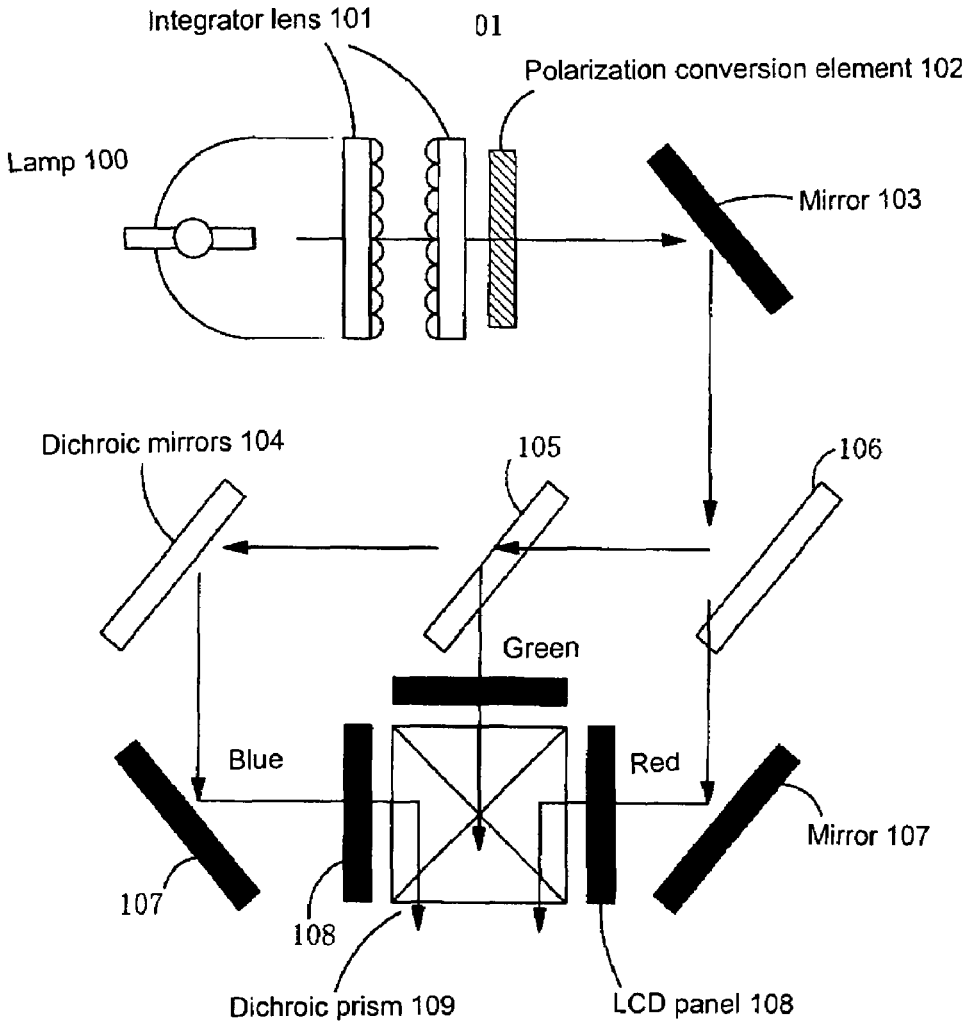
FIG. 11 shows a schematic structure of the projector apparatus using a liquid crystal panel.
Figure 12:
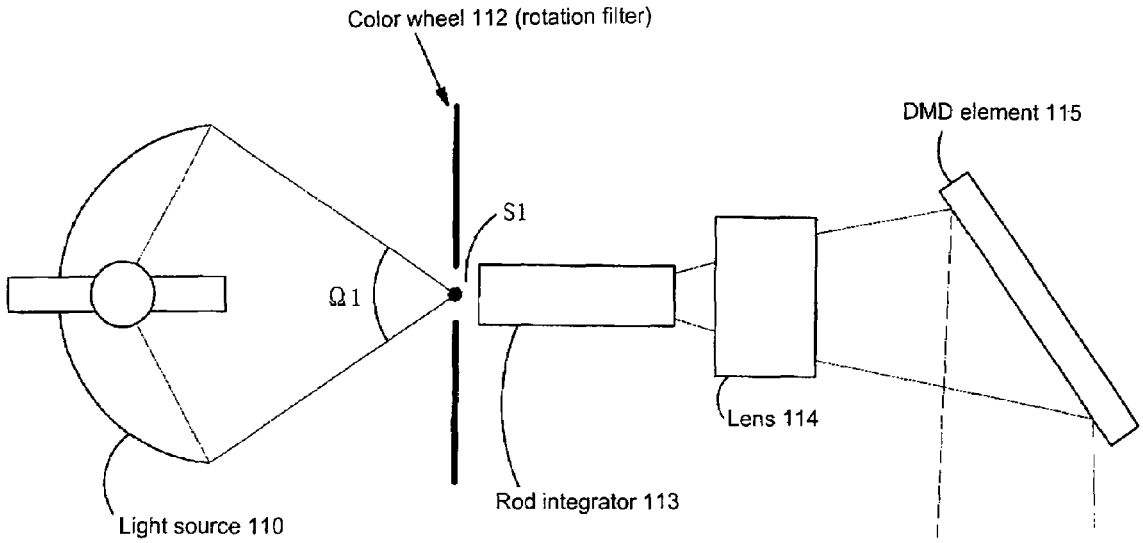
FIG. 12 is a diagram for explaining a problem when a projector apparatus using a DMD element is miniaturized.
Figure 13:
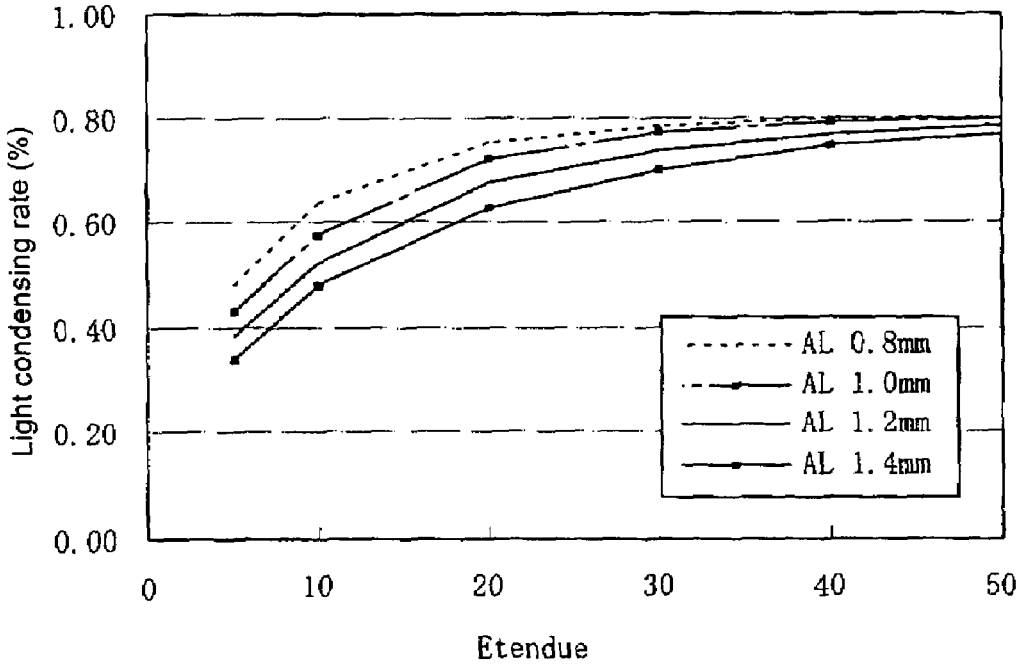
FIG. 13 shows a simulation result of an arc length, an etendue, and a light collecting rate.

FIG. 8 is a time chart showing an operation at the time of a lamp lighting start, and FIG. 9 is a flow chart showing an operation of the control unit 26. A description of the operation of the control unit 26 will be given referring to the figures. First, the polarity of the full bridge circuit 12 is fixed (for example, the switching elements S2 and S5 are turned on and the switching elements S3 and S4 are turned of), while the starting section 26*a* of the control section 26 starts the timer circuit 26*b*, and as shown in (1) and (2) of FIG. 8, an open voltage is applied to the lamp 1 (Steps S1 and S2 of FIG. 9). Subsequently, as shown in (3) of FIG. 8, an operation of the igniter circuit is started and the voltage of several kV by the igniter circuit is impressed thereto. Moreover, constant current control of the current which flows through the lamp 1 is started (Step S3 of FIG. 9). In this manner, as shown in FIG. 8, after electric discharge from the mercury adhering to the electrode of the lamp is carried out, glow discharge occurs between the electrodes, and the state of the electric discharge shifts to arc discharge from the glow discharge. Then, as shown in (4) of FIG. 8 while detection of the lamp voltage is started, several seconds after the timer circuit 26*b* is started, an operation of a protection circuit (not shown) which protects the lamp etc. is started (Steps S4-S5 of FIG. 9).

Subsequently, the control as set forth below is performed according to the present embodiment. First, the duty ratio selection section 26*c* of the control unit 26 sets the duty ratio to temporary value (for example, 45%), and as shown in (5) of FIG. 8, the full bridge circuit 12 starts an AC operation (Step S6). As shown in (6) of FIG. 8, when the lamp voltage goes up to the fixed voltage, the duty ratio selection section 26*c* switches the operation of the comparator 24, so as to shift to the fixed electric power control (Step S7). Subsequently, the duty ratio selection section 26*c* checks the lamp voltage, and determines the duty ratio to be used with reference to the lamp voltage duty ratio conversion table 26*e*. The drive signal generation section 26*d* generates a drive signal of the determined duty ratio, and the full bridge circuit is driven by the full bridge drive circuit 21 (Steps S9 and S10). And after updating the duty ratio, it is determined whether the duty ratio renewal time (for example, 1 hour) elapses (Step S11), and if the duty ratio renewal time elapses, the process returns to Step S8 thereby updating the duty ratio. Moreover, if the duty ratio renewal time does not elapse, it is checked whether the lamp is turned off (Step S12), and if it is not turned off, the process returns to Step S11 and the above-mentioned process is repeated. Moreover, if it is turned off, the operation of the lighting circuit is stopped (Step S13).

Conventionally, a lamp is turned on in a DC lighting or at high frequency, in an early stage when the electronic properties are unstable, and when the lamp is in a steady state, the full bridge circuit is driven at a constant frequency and 50% duty ratio so as to light the lamp in an alternating current lighting. However, in the present embodiment, since an alternating current with a duty ratio of less than 45% is impressed to the lamp 1, as mentioned above, so as to turn on the lamp, it is possible to turn on the lamp in a state of an unbalanced luminance distribution, so that the luminescent spot becomes small, and the use efficiency of light can be improved. Moreover, as mentioned above, when the lamp voltage becomes high, by controlling a duty ratio so as to be small according to the raised voltage, a change of the arc length in a life span thereof is small, and it is possible to increase the use efficiency of light.

The preceding description has been presented only to illustrate and describe exemplary embodiments of the high pressure discharge lamp lighting apparatus according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A high pressure discharge lamp lighting apparatus comprising:

a high pressure discharge lamp including a discharge container made of quartz glass in which mercury and halogen is enclosed, and first and second electrodes in which the first electrode is larger than the second electrode in size, an alternating voltage generating circuit; and a control unit, wherein the alternating voltage generating circuit impresses an alternating voltage to the first and second electrodes of the high pressure discharge lamp, wherein the control unit controls the alternating voltage generating circuit, so that a first period in a cycle of a positive part of the alternating voltage impressed to the first electrode is longer than a second period in a cycle of a positive part of the alternating voltage impressed to the second electrode.

2. The high pressure discharge lamp lighting apparatus according to claim 1, wherein the control unit detects a lamp voltage, and a ratio of the first period and the second period is changed according to the lamp voltage.

3. The high pressure discharge lamp lighting apparatus according to claim 1, wherein the alternating voltage generating circuit is a full bridge circuit.

4. A high pressure discharge lamp lighting apparatus comprising:

a high pressure discharge lamp including a discharge container, and first and second electrodes which face each other, an alternating voltage generating circuit; and a control unit, wherein the alternating voltage generating circuit impresses alternating voltage between the first and second electrodes of the high pressure discharge lamp, and wherein the control unit controls the alternating voltage generating circuit, so as to satisfy a relation of $T1-T2>T2$ where $T1$ represents one cycle of the alternating voltage and $T2$ represents a period during which in the one cycle, plus voltage is impressed to the first electrode, so that $T1-T2$ represents a period during which plus voltage is impressed to the second electrode.

5. The high pressure discharge lamp lighting apparatus according to claim 4, wherein the first electrode is larger than the second electrode in size.

6. The high pressure discharge lamp lighting apparatus according to claim 4, wherein the control unit detects a lamp voltage, and a duty ratio $T2/T1$ of the first period and the second period is changed according to the lamp voltage.

7. The high pressure discharge lamp lighting apparatus according to claim 6, wherein the control unit includes a timer which is started when lighting is started, and after lapse of a predetermined time from, the control unit starts detecting the lamp voltage.

* * * * *